US005506596A

United States Patent [19]

Pacholok

[11] Patent Number: 5,506,596

[45] Date of Patent: Apr. 9, 1996

[54] REDUCED TENSION MODULAR NEON SIGN SYSTEM

[75] Inventor: David Pacholok, Sleepy Hollow, Ill.

[73] Assignee: Everbrite, Inc., Greenfield, Wis.

[21] Appl. No.: 312,427

[22] Filed: Sep. 26, 1994

Related U.S. Application Data

[63] Continuation of Ser. No. 958,247, Oct. 8, 1993, abandoned.

[51] Int. Cl.[6] ..... G09G 3/10

[52] U.S. Cl. ..... 345/42; 345/41; 439/226

[58] Field of Search ..... 439/226, 227, 439/243, 244; 40/545, 541; 315/58, 71, 201, 227 R, 205, 59; 340/815.4; 345/41, 42, 44, 30, 33

[56] References Cited

U.S. PATENT DOCUMENTS

| | | | |
|---|---|---|---|
| 454,622 | 6/1891 | Tesla | 315/227 R |
| 2,344,815 | 3/1944 | Guyral | 439/226 |
| 2,716,205 | 8/1955 | Feinberg | 439/226 |
| 4,388,562 | 6/1983 | Josephson | 315/205 |
| 4,488,090 | 12/1984 | Hancock | 315/201 |
| 4,912,368 | 3/1990 | Nishiyama | 315/58 |
| 4,969,282 | 11/1990 | Eberhart | 40/545 |

*Primary Examiner*—Curtis Kunte
*Assistant Examiner*—Vivian W. Chang
*Attorney, Agent, or Firm*—Maksymonko & Slater

[57] ABSTRACT

A modular neon sign system comprising two or more independent neon or similar luminous tube segments. One or more of the luminous segments are arranged in generally parallel configuration across the remaining tube segments and each such parallel segment includes a series capacitive ballasting element to selectively control the current through the respective segment. Receptacles may be provided to facilitate the attachment of the parallel segments thereby forming detachable neon modules. The capacitive ballasting element is preferably a ceramic button-like disc that may be connected to an end of the parallel neon module or inserted into the receptacle. In one embodiment the several parallel segments are connected to a reduced tension constant voltage power supply. In a second erabodiment, a constant current power supply is continuously interconnected to one or more neon luminous tubes that define a fixed portion of the sign with the parallel segment(s) or module(s) being connected across said fixed portion.

11 Claims, 1 Drawing Sheet

FIG. 1
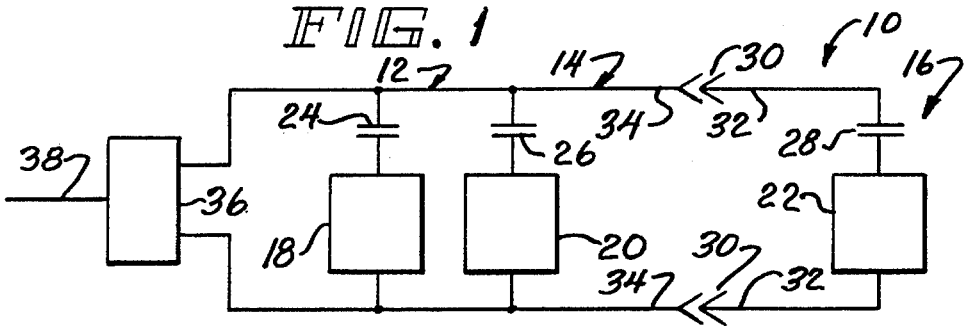
FIG. 2
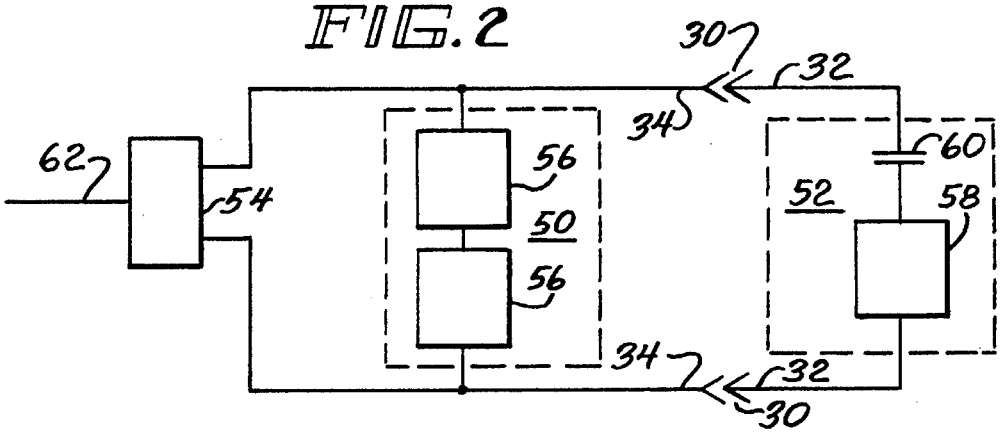
FIG. 4
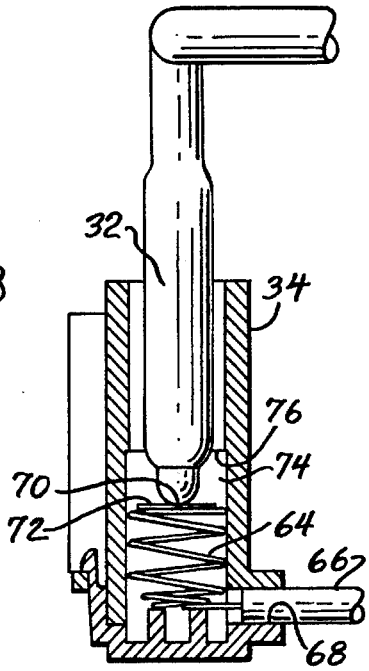
FIG. 5
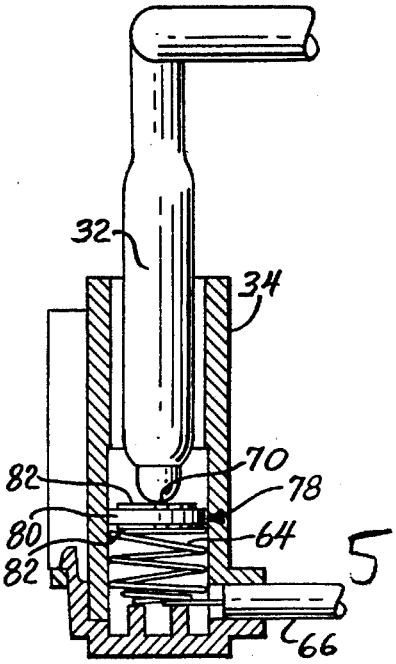
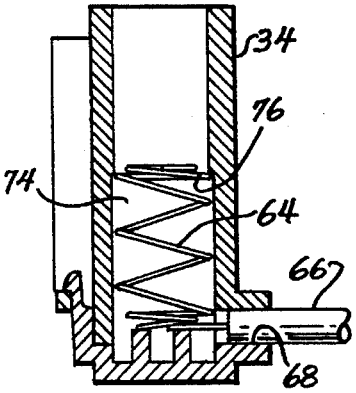
FIG. 3

REDUCED TENSION MODULAR NEON SIGN SYSTEM

This application is a continuation of application Ser. No. 958,247, filed Oct. 8, 1993, now abandoned.

BACKGROUND OF THE INVENTION

The present invention relates to high frequency power supplies for exciting gas-filled luminous tubes, for example, decorative and promotional neon signage. More specifically, the present invention pertains to alternative neon tube ballasting and hook-up topology that facilitates use of lower tension (voltage) power supply sources and, further, modular sign configurations that permit removal and/or substitution of sign segments.

Conventional neon signs consist of one or more series-connected neon or other gaseous tube segments. The "series" topology has been universally adopted to assure, in the first instance, substantially uniform current flow and corresponding brightness of each luminous tube segment. Further, the series configuration has heretofore been mandated by the ionization potential and negative resistance characteristics of the gaseous luminous tube, itself, which characteristics result in a substantial reduction in tube operating voltage once gas excitation has occurred. This latter property, in turn, virtually guarantees that one or more tubes—if connected in parallel—will not excite or illuminate with equal intensity.

The series configuration, however, is not without its limitations. One such limitation, for example, pertains to the maximum system operating voltage. Successively higher tension (voltage) power supplies—as required to operate correspondingly larger neon signs—create a host of insulation, arcing and corona problems. Thus, the practical upper voltage limit in the neon sign industry is considered to be about 15 KV. And, indeed, even this voltage may be unrealistically high in special situations where, for example, movable neon segments (e.g. clock hands) may require slip-connections capable of operating at full system voltage.

It is well known that luminous tube excitation and sustaining (operating) voltages are proportional to tube lengths. Thus, the 15 KV limit translates to a maximum sign length between 30 and 100 feet. And it is important to remember that this maximum is true without regard to whether the sign is comprised of a single neon tube or the series connection of plural tube segments—the overall length of all segments cannot exceed the 100 foot limit. Where larger (longer) signs are desired, prior designs have required the use of multiple power supplies.

A second restriction—common to all series-configured elements—is the fact that an interruption of current flow through any element causes the cessation of current through all elements. Thus, the removal of any tube segment in a conventional neon sign results in the corresponding shutdown of sign tube elements.

One object of the present invention is the ability to achieve a modular neon sign system in which one or more modules may be removed or substituted without disabling normal illumination of the remaining sign tube segments or modules. This feature advantageously permits use of a common sign that may be field fitted, or retrofitted, with site-specific removable sign modules.

A further and inherent disadvantage of conventional series topology relates to Kirchoff's current law, namely, the same magnitude current must pass through sign elements. In many situations this "limitation" may, in fact, be deemed a positive attribute as it assures substantially equal illumination of sign segments. In the present context, however, in particular where differing and removable sign modules are contemplated, the equal-current limitation is seen to unduly restrict artistic options.

It is well known that neon signs require some form of series impedance or ballast when powering neon tubes from a voltage source. This impedance is almost universally found as "leakage inductance" in the power supply transformer—and this is true whether the supply is of the standard line frequency step-up transformer variety or the increasingly popular high frequency oscillator/invertor configuration.

Use of capacitive ballasting has not worked well in the past, particularly in connection with standard 60 Hz supplies, due to the inability of this technique to control instantaneous tube currents. More specifically, upon gas avalanche a massive current spike is induced which may result in tube flickering and eventual electrode damage. Capacitive ballasting, however, has been found to work so long as the operating frequency of the power supply is maintained above the neon tube time constant (i.e. $\frac{1}{2\pi f_o} < T$). Frequencies above 15 KHz meet this requirement for both neon and mercury, the two most common gases utilized in so-called "neon" signage.

As a consequence of the above, one embodiment of the present invention contemplates use of a relatively low voltage constant voltage power source, for example 3 KV, coupled to plural, parallel-configured neon elements or modules—each module comprised of a neon tube segment and an associated capacitor which capacitor is preferably integrated into the module interconnection system. The actual supply voltage is selected to assure proper excitation of the longest tube contemplated. Whatever the voltage, it will be appreciated that a substantially lower voltage will be required as compared to the alternative sign in which the same tube elements are employed, but arranged in the conventional series configuration.

Several important features, in addition to reduced supply tension, are achieved with the above-described individually ballasted neontube elements. First, any neon element may be removed with little or no effect on the continued ordinary operation of remaining neon elements. Thus, greater sign flexibility is obtained whereby sign elements or "modules" may be added, substituted, or removed as required to achieve a desired site-specific message.

A further advantage of this multiple ballasting topology is the ease by which individual neon tube currents (and corresponding illumination intensities) may be controlled to facilitate artistic flexibility. As tube current is directly proportional to ballast capacitance, individual tube intensities may be selected or changed by corresponding capacitor selections. No longer must tubes operate at the same intensity.

As noted, a feature of the present invention is the modular construction whereby a neon tube segment may be removed or substituted without otherwise interrupting proper sign operation. To this end, it is contemplated that modules may be electrically, if not mechanically, interconnected through employment of a pair of electrode receptacles. In a preferred arrangement, each receptacle would comprise and define a cylindrical recess into which an electrode end of a neon tube would be received. It is further contemplated that a metallic spring would be positioned in each receptacle to receive and electrically interconnect to the electrode.

Ballasting capacitors may be fabricated from appropriate ceramic material advantageously formed as discs of diameter corresponding to that of the receptacle whereby the capacitor may be positioned between the receptacle spring and neon tube electrode end. It will be appreciated that the precise ceramic material, the thickness and metallic plating area thereon are each parameters that, in accordance with known principles, may be appropriately selected to achieve the desired capacitance and ballasting effect. It is contemplated that these capacitance "buttons" may be inserted, as separate and independent components, into the receptacles or they may affixed by appropriate means to the electrode ends of the neon tube segments thereby defining integral modules for insertion into the receptacles. In either event, it is contemplated that the capacitance buttons sh be easily removable to facilitate the interchange of capacitance values as may be desired.

In another embodiment of the present invention, a sign is comprised of plural parallel neon elements including a fixed portion and one or more detachable modules. Unlike the above-described sign in which plural capacitance-ballasted modules are connected in parallel across a constant voltage power supply, the fixed portion of this second embodiment is not ballasted and is connected across a more-conventional constant current supply, albeit one of reduced tension. The fixed portion may be a single neon segment or it may be multiple series-connected tube sections. It will be appreciated, however, that the over length of the fixed section, and therefore the corresponding voltage of the power supply, will be significantly lower than that of conventional sign topology by reason of the effective transfer or relocation of the neon comprising the modules from an otherwise series string to a parallel connection.

The neon modules in this second embodiment are substantially as discussed above. Each is preferably received within a pair of receptacles and each incorporates appropriate current limiting, ceramic ballasting capacitor. Ballasting capacitors are not required in connection with the fixed portion of the sign by reason of the inherent current limiting afforded by the constant current supply, across which the fixed portion is connected.

It will be appreciated that the constant current supply and the fixed portion of the neon sign cooperate to generate the constant voltage output required by the capacitance-ballasted modular portions of the sign. More specifically, the voltage across the fixed neon portion of the sign is substantially constant once the neon gas has been excited into conduction. The fixed portion is, in essence, performing the dual function of, first, a sign element and, second, a voltage regulator.

It is therefore an object of the present invention to facilitate a modular sign topology whereby one or more modules may be removed, substituted, or added to the sign without adversely impacting the normal operation thereof.

It is a further object of the present invention that the sign modules may be installed or removed without great effort preferably admitting of field service in connection with same.

It is another object of the present invention that the illumination intensities of the various neon segments, in particular the modular portions, may differ and may be independently selected.

It is yet another object of the present invention that the power supply operate at lower voltages than those of conventional sign topologies for a given over length of neon tube.

These and various other objects and advantages of the invention will hereinafter become more fully apparent from the following description of the embodiments and the drawings wherein:

FIG. 1 is a block representation of the reduced tension modular neon sign system of the present invention;

FIG. 2 is a block representation of another embodiment of the reduced tension modular neon sign system of the present invention;

FIG. 3 is an elevation view, partially in section, of the modular neon tube receptacle of the present invention;

FIG. 4 is an elevation view, partially in section, of the receptacle of FIG. 3 shown with the electrode tube end of a neon segment inserted therein; and, FIG. 5 is a elevation view, partially in section, of the receptacle of FIG. 4 shown with the ceramic ballasting capacitor therein.

DESCRIPTION OF THE PREFERRED EMBODIMENT

FIG. 1 illustrates one embodiment 10 of the present reduced tension modular sign system illustrating three generally parallel tube modules 12, 14, and 16. Each module is comprised of a neon, mercury or similar luminous gas tube 18, 20, and 22 and an associated capacitive ballasting element 24, 26, and 28. Neon module 16 is shown interconnected to the sign 10 through a pair of connectors 30. As discussed in more detail below, these connectors are preferably comprised of, or defined by, the respective tube electrode ends 32 and mating cylindrical receptacles 34. It will be understood that fewer or additional neon modules may be employed and, similarly, that any number of these modules may be interconnected using connectors 30.

The several modules are connected as previously noted in parallel across a constant voltage high frequency power supply 36 which, in turn, is connected to a conventional source of line power 38. The supply operating frequency, 20 KHz for example, is not critical so long as operation is maintained above the ionization time constant of the gases being employed:

$$\frac{1}{2 \cdot \pi \cdot f_o} < T$$

where

T=Gas Tube time Constant $f_o$=Supply Operating Frequency

Generally, operation at 15KHz or higher is sufficient in this context. The power supply output voltage must, in addition, be higher than the starting voltage of the longest luminous tube segment. A supply voltage of 3 KV is typical and generally sufficient.

A significant feature of the above-described modular topology is the ability to independently adjust the current through, and therefore brightness of, each modular tube segment according to the following relationship:

$$I_n = \frac{V_{out}}{(X_n^2 + R_n^2)^{0.5}}$$

where $V_{out}$=Power Supply Output Voltage $X_n = 1/(2\pi f_o C_n)$ $R_n$=Tube Resistance=$V_n/I_n$ Thus, by way of example, for a tube of length corresponding to an operating voltage of 1000 volts is to operate at 10 milliamperes from a 3 KV supply, the tube resistance will be 100 KΩ. Plugging these numbers into the above equation and solving for $X_n$:

$$0.01 = \frac{3000}{(X_n^2 + 100K^2)^{0.5}}$$

And solving for the capacitive reactance:

$X_n$=283 KΩ

Finally, at a supply frequency of 20 KHz, the above reactance, $X_n$, requires a capacitance of:

$C_n$=28 picofarads.

This same procedure is repeated for each of the modular segments substituting as required the corresponding luminous tube operating voltage and desired current (selected in accordance with the brightness desired).

FIG. 2 illustrates a second embodiment of the present reduced tension modular neon sign system including the parallel connection of fixed and modular (i.e. removable) sign portions 50 and 52, respectively, across a high frequency power supply 54. As before, supply 54 is connected to a conventional source of low frequency line power at 62.

The fixed sign portion 50 is comprised of one or more neon, mercury, or similar gas tubes segments 56 arranged in a series configuration and permanently connected across supply 54. In this embodiment, a generally constant current supply 54 of typically between about 8–9 KV is employed. The precise open circuit output voltage of this supply will depend on the over length of the several luminous tube segments 56 but, in any event, it will be appreciated that the over voltage of supply 54 will be reduced by reason that the tube segment(s) 58 comprising the modular portion 52 of the sign has, by reason of its ballasted parallel connection, been effectively removed from its otherwise conventional, voltage-increasing orientation as an additional element in series with tubes 56.

The modular portion 52 is ordinarily comprised of a single luminous tube segment 58 ballasted, substantially as described above, by a series-configured high voltage ceramic capacitor 60, the combination of which is placed in parallel across the fixed portion 50. Tube 58, however, may incorporate multiple neon tube segments are required by sign design.

To achieve removability, and substitutability, the electrical and, in part, mechanical interface between the fixed and modular portions is effected by connectors 30. Again, these connectors are comprised of the male electrode ends 32 of the neon tubes, themselves, and the cylindrical receptacles 34 into which the tube ends 32 are received. As described below, ballasting capacitor 60 is preferably a high voltage ceramic "disc" which seats within or is mounted to the tube end or receptacle to form an integral assembly therewith. It will be understood that multiple modules 52 may be employed as desired.

The several elements described above, including supply 54 and fixed and modular portions 50,52, uniquely cooperate as an ensemble to achieve the objectives of reduced tension and modularity. For example, and as previously noted, the parallel configuration advantageously reduces the over voltage required for any given neon sign design, that is, for any given total length of neon tubing required, while simultaneously admitting of plural tube operating currents (i.e. intensities). This configuration, however, is most efficaciously practiced through the use of independent tube ballasting which, in turn, requires a predictable and fixed voltage source thereby to "lock-in" the resulting current through the ballasting capacitor and tube segment.

Capacitive ballasting, however, forces higher operating voltages to be placed across such ballasted modules by reason that a substantial voltage—in addition to that required to operate the neon tube itself—must appear across the capacitor which, in turn, assures that the capacitor be able to perform its current controlling function without becoming unduly sensitive to supply voltage variations. In this connection it should be remembered that, due to the constant voltage characteristic of a neon tube, any variation in power supply voltage will be impressed substantially in its entirety across the ballasting capacitance. And if the nominal operating voltage across such capacitor is low, as compared to that of the tube and overall supply, then correspondingly smaller percentage power supply voltage variations will result in relatively larger percentage capacitor voltage variations, in turn, in similarly large excursions of capacitor and tube current.

In view of the foregoing, and as a means to achieve the maximum overall tube length at a reduced voltage (tension), the modular neon sign of FIG. 2 employs a non-ballasted arrangement for its fixed portion 50. It will immediately be understood that in the absence of the current-limiting ballast capacitance, the fixed portion 50 cannot be placed across a constant voltage supply without incurring unpredictable and certainly excessive currents therethrough. It is for this reason that supply 54 is of the non-constant voltage, generally constant current variety.

As discussed, such a variable voltage supply 54 would not, under ordinary circumstances, be suitable for powering the capacitive ballasted modular portion 52—the latter requiring a fixed voltage source. However, the previously alluded to cooperation of elements obviates this problem by reason that the neon tubes 56, which comprise the fixed portion 50 of the sign, advantageously serve, in addition to their primary "illumination" duties, as a voltage regulator thereby providing, in turn, the substantially uniform voltage source required by the removable modular portion 52.

FIGS. 3–5 further illustrate the connector receptacle 34 shown schematically in FIGS. 1 and 2. Receptacle 34 is preferably of cylindrical cross-section having an inside diameter somewhat larger than that of the neon tube electrode 32 whereby the electrode 32 is received within the receptacle as shown in FIG. 4. A compression spring 64 is positioned in the lower or bottom region of the receptacle.

As seen through a comparison of respective spring positions in FIGS. 3 and 4, spring 64 is compressed upon insertion of electrode 32 into the receptacle. Spring 64, in turn, serves as the electrical interconnection between the power supply lead 66, which lead enters through an opening 68 provided in the bottom of the receptacle, and the tip end 70 of the neon tube electrode 32. A washer-like metallic disc 72 (FIG. 4) may be connected to the conductor (not shown) extending from the electrode tip or to the top of spring 64 to assure proper electrical interconnection between neon tube and spring. Multiple openings 68 may be provided to facilitate the interconnection of additional modules or neon segments, either in a series or parallel configuration.

Referring to FIG. 4, it will be seen that the inside diameter of the bottom portion 74 of receptacle 34 defines a slightly increased diameter (as contrasted with the upper region thereof). The resulting discontinuity in receptacle inner diameter forms and defines an annular ridge at 76 which ridge functions to restrain the spring against further upward travel, ie. upward beyond the level of ridge 76, and inadvertent loss of the spring from the receptacle.

FIG. 5 illustrates an electrode/receptacle interconnection similar to that shown and described in connection with FIGS. 3 and 4, above, but with the addition of ballasting capacitor 78. It will be understood that capacitor 78 (FIG. 5) generally corresponds to capacitors 24, 26, 28, and 60 shown schematically in FIGS. 1 and 2. These capacitors are preferably fabricated from high voltage ceramic dielectric material 80 and include sufficient metallic plating 82 on opposed surfaces as appropriate to the required capacitance thereof.

Referring again to FIG. 5, spring 64 urges capacitor 78 upwardly thereby assuring electrical engagement of the spring 64 and electrode tip 70 against the respective capacitor plates 82. Capacitor 78 may advantageously be formed as a disc of such diameter that it freely travels within the lower portion 74 of the receptacle while being inhibited, by annular ridge 76, from moving upwardly from said ridge.

It will be appreciated that not every connection 30 requires a ballasting capacitor. Generally a single capacitor 78 is employed for each neon module, for example module 52 of FIG. 2, and therefore one electrode receptacle will incorporate such capacitor and one will not.

I claim:

1. A modular luminous tube sign including the parallel interconnection of a high frequency current source, a first portion, and at least one modular portion; the first portion having at least one luminous tube defining a starting voltage and an operating voltage; the modular portion having at least one luminous tube defining a starting voltage and an operating voltage and means operatively connected in series with the modular portion luminous tube for converting a constant voltage source into a constant current source of predetermined current; the high frequency current source having an open circuit output voltage greater than the first portion starting voltage whereby the gas of the first portion luminous tube excites thereby causing said tube to illuminate and to lower and clamp the voltage from the current source at the first tube operating voltage whereby said combination of the current source and the first portion luminous tube defines a voltage source; the modular portion starting voltage being less than the first portion operating voltage whereby the modular portion tube will illuminate at a brightness determined by the predetermined current of the converting means; connector means operatively interposed between at least one of the modular portion and the parallel interconnection of the power supply source and first portion whereby the modular portion may be removed from the sign and whereby another modular portion may be substituted for said removed modular portion such that the first portion remains illuminated without regard to the connection and substitution of a modular portion thereby defining a luminous sign system in which differing messages can be provided by the field or other installation, substitution or removal of modular portions.

2. The modular luminous sign of claim 1 in which the connector means includes receptacles operatively affixed to the parallel interconnection, the receptacles having openings therein into which the electrode ends of the modular portion luminous tube may be inserted thereby interconnecting the modular portion to the sign at said parallel interconnection whereby differing sign messages may be provided by the field or other installation, substitution or removal of modular portions.

3. The modular luminous sign of claim 1 in which the converting means includes capacitive means integrally incorporated into the connector means.

4. The modular luminous sign of claim 3 in which the capacitive means is a metallic plated disc having cross-section dimensions substantially equal to, but slightly less than, a receptacle opening, said capacitive disc is positioned in the receptacle opening whereby the electrical series engagement of the capacitive means occurs upon insertion of the modular portion luminous tube electrodes into the receptacles.

5. The modular luminous sign of claim 4 including means in the receptacle opening to preclude the unrestrained outward movement of the capacitive means whereby the capacitive means cannot inadvertently be removed or lost from the receptacle even upon removal of the modular portion electrode therefrom.

6. A modular luminous tube sign including the parallel interconnection of a high frequency power supply source and plural modular portions; the high frequency supply having a predetermined and substantially constant output voltage; each modular portion having at least one luminous tube and means operatively connected in series with the luminous tube for converting a constant voltage source into a constant current source of predetermined current, the luminous tube defining a respective starting voltage, the predetermined power supply output voltage being greater than the highest modular portion luminous tube starting voltage whereby each modular portion luminous tube will illuminate at a brightness determined by the predetermined current of the converting means whereby the brightness of each modular portion may be independently predetermined and whereby one or more modular portions may be removed, added or substituted without causing substantial change in brightness of the remaining modular portions thereby defining a luminous sign system in which differing messages can be provided by the field or other installation, substitution or removal of modular portions.

7. A modular luminous tube sign including the parallel interconnection of a high frequency power supply source and plural modular portions; the high frequency supply having a predetermined and substantially constant output voltage; each modular portion having at least one luminous tube and a capacitive means operatively connected in series with the luminous tube, the luminious tube defining a respective starting voltage, the predetermined power supply output voltage being greater than the highest modular portion luminous tube starting voltage whereby each modular portion luminous tube will illuminate at a brightness determined by the reactance of its respective capacitive means whereby the brightness of each modular portion may be independently predetermined; connector means operatively interposed between at least one of the modular portions and the parallel interconnection whereby one or more modular portions may be removed, added or substituted without causing substantial change in brightness of the remaining modular portions thereby defining a luminous sign system in which differing messages can be provided by the field or other installation, substitution or removal of modular portions.

8. The modular luminous sign of claim 7 in which the connector means includes receptacles operatively affixed to the parallel interconnection, the receptacles having openings therein into which the electrode ends of the modular portion luminous tube may be inserted thereby interconnecting the modular portion to the sign at said parallel interconnection whereby differing sign messages may be provided by the field or other installation, substitution or removal of modular portions.

9. The modular luminous sign of claim 7 in which the capacitive means is integrally incorporated into the connector means.

10. The modular luminous sign of claim 7 in which the the capacitive means is a metallic plated disc having cross-section dimensions substantially equal to, but slightly less than, a receptacle opening, said capacitive disc being positioned in the receptacle opening whereby the electrical series engagement of the capacitive means occurs upon insertion of the modular portion luminous tube electrodes into the receptacles.

11. The modular luminous sign of claim 10 including means in the receptacle opening to preclude the unrestrained outward movement of the capacitive means whereby the capacitive means cannot inadvertently be removed or lost from the receptacle even upon removal of the modular portion electrode therefrom.

* * * * *